US008167055B2

(12) United States Patent
Piras

(10) Patent No.: US 8,167,055 B2
(45) Date of Patent: May 1, 2012

(54) PERCUSSION DEVICE ACTUATED BY A PRESSURIZED NON-COMPRESSIBLE FLUID

(75) Inventor: Bernard Piras, Vernaison (FR)

(73) Assignee: Montabert, Saint Priest (FR)

( * ) Notice: Subject to any disclaimer, the term of this patent is extended or adjusted under 35 U.S.C. 154(b) by 301 days.

(21) Appl. No.: 12/451,186

(22) PCT Filed: May 21, 2008

(86) PCT No.: PCT/FR2008/050877

§ 371 (c)(1),
(2), (4) Date: Nov. 19, 2009

(87) PCT Pub. No.: WO2008/149030

PCT Pub. Date: Dec. 11, 2008

(65) Prior Publication Data

US 2010/0084152 A1 Apr. 8, 2010

(30) Foreign Application Priority Data

May 25, 2007 (FR) ..... 07 03727

(51) Int. Cl.
*B25D 9/12* (2006.01)

(52) U.S. Cl. ..... 173/138; 173/206; 173/207; 173/208

(58) Field of Classification Search ..... 173/138, 173/206, 207, 208
See application file for complete search history.

(56) References Cited

U.S. PATENT DOCUMENTS 3,872,934 A * 3/1975 Terada ..... 173/207
3,991,655 A * 11/1976 Bouyoucos et al. ..... 91/276
4,052,107 A * 10/1977 Hay ..... 299/62
4,082,471 A * 4/1978 Hiszpanski ..... 404/133.1
4,563,938 A * 1/1986 Henriksson ..... 91/25
4,858,702 A * 8/1989 Piras ..... 173/208
4,899,836 A * 2/1990 Vernot ..... 173/207

(Continued)

FOREIGN PATENT DOCUMENTS

DE 35 22 450 A1 1/1987

(Continued)

OTHER PUBLICATIONS

Dec. 4, 2008 Search Report issued in International Patent Application No. PCT/FR2008/050877 (with translation).
Weishaupt et al., "Energiesparende elektrohydraulische Schaltungskonzepte," Olhydraulik und Pneumatik, Jan. 1995, pp. 106-112, vol. 39, No. 2, Germany.

(Continued)

*Primary Examiner* — Brian D Nash
(74) *Attorney, Agent, or Firm* — Oliff & Berridge, PLC

(57) ABSTRACT

According to the invention, the body of the apparatus includes a flow rate adjustment device including a calibrated opening provided on a high-pressure fluid supply circuit, a bore formed in the body and in which is mounted a slider having a first face located in a first chamber connected to a high-pressure fluid supply circuit upstream from the calibrated opening and a second face located in a second chamber connected to the high-pressure fluid supply circuit downstream from the calibrated opening, the bore receiving the slide including an annular groove connected to a low pressure feedback circuit. The slider is adapted for connecting the annular groove to the first chamber when the pressure difference on either side of the calibrated opening increases beyond a predetermined value in order to divert a portion of the fluid flow supplied by the high-pressure fluid supply circuit to the feedback circuit.

7 Claims, 6 Drawing Sheets

U.S. PATENT DOCUMENTS

| | | | | |
|---|---|---|---|---|
| 5,046,310 | A | 9/1991 | Kauss | |
| 5,056,606 | A * | 10/1991 | Barthomeuf | 173/13 |
| 5,392,865 | A * | 2/1995 | Piras | 173/17 |
| 6,829,975 | B2 * | 12/2004 | Piras | 91/303 |
| 6,901,842 | B2 * | 6/2005 | Piras | 91/286 |
| 2003/0183402 | A1 * | 10/2003 | Piras | 173/206 |
| 2004/0050243 | A1 * | 3/2004 | Piras | 91/327 |
| 2007/0079697 | A1 | 4/2007 | Comarmond | |

FOREIGN PATENT DOCUMENTS

| | | | |
|---|---|---|---|
| EP | 688636 | A1 * | 12/1995 |
| FR | 2 863 671 | A1 | 6/2005 |
| WO | WO 02/090736 | A2 | 11/2002 |

OTHER PUBLICATIONS

Esders, "Elektrohydraulisches Load-Sensing für die Mobilhydraulik," Olhydraulik und Pneumatik, Jan. 1994, pp. 473-478 & 480, vol. 38, No. 8, Germany.

* cited by examiner

PERCUSSION DEVICE ACTUATED BY A PRESSURIZED NON-COMPRESSIBLE FLUID

The subject of the present invention is a percussion device actuated by a pressurized incompressible fluid.

Percussion devices actuated by an incompressible fluid under pressure are supplied with fluid in such a way that the resultant of the hydraulic forces applied in succession to the striking piston moves this piston back and forth in one direction then the other. In general, these devices are designed to operate with a fluid the pressure of which is induced by the internal resistance of the device or is set in a range of supply flow rates chosen when the device is being designed.

If the device is oversupplied with pressurized fluid, there is a risk of a considerable increase in the operating pressure. Because the movement of the piston is generally uniformly accelerated as a function of the pressure of the supply fluid, the impact speed of this piston will therefore be dependent on this acceleration and may exceed the limits of the mechanical properties of steel if this speed is not properly controlled. It is therefore essential for the user to adhere unfailingly to the technical instructions given by the manufacturer of the device.

In many instances it is necessary to alter the hydraulic parameters of the carrying equipment on which the percussion device is mounted in order to be able to adhere to the data provided by the manufacturer of this device, and these complex alterations are subject to error.

Furthermore, some years ago hydraulic equipment capable of operating percussion devices, grippers, grabs, grinders and all manner of devices the characteristics and pressurized-fluid requirements of which differ widely appeared on the market. This type of hydraulic equipment comprises, in a known way, a selector situated in the cab of the equipment and allowing the type of device to be supplied with fluid to be selected. However, given that this type of carrying equipment does not generally comprise any error-proofing means upstream of these various accessories, it is possible for a percussion device mounted on the carrying equipment to be accidentally oversupplied, and thereby damaged.

It is an object of the invention therefore to provide a device for implementing it, affording protection for the device against accidental flow rate oversupplies, which is simple, reliable and inexpensive.

To this end, the present invention relates to a percussion device actuated by a pressurized incompressible fluid, the supply of fluid to which is performed by a high-pressure fluid supply circuit and a low-pressure return circuit, characterized in that the body of the device comprises a flow regulator, the flow regulator comprising a first calibrated orifice situated on the high-pressure fluid supply circuit, a bore formed in the body of the device and in which there is mounted a slide a first face of which is situated in a first chamber connected to the high-pressure fluid supply circuit upstream of the first calibrated orifice and the second face of which is situated in a second chamber connected to the high-pressure fluid supply circuit downstream of the first calibrated orifice, the bore accepting the slide of the regulator comprising an annular groove connected to the return circuit of the percussion device, and in that the slide of the regulator is designed to connect the annular groove to the first chamber where the pressure difference across the first calibrated orifice increases beyond a predetermined value, so as to divert some of the fluid flow supplied by the high-pressure fluid supply circuit to the return circuit.

Thus, the configuration of the flow regulator and of the annular groove allows the flow rate of pressurized fluid that can be carried within the percussion device to be limited to a predetermined value, thus avoiding accidental oversupply of this device.

According to one embodiment of the invention, the slide of the flow regulator is designed to divert to the return circuit any excess flow supplied by the high-pressure fluid supply circuit by comparison with the predetermined flow rate value.

Thus, the flow regulator according to the invention allows any flow that is in excess of a predetermined flow rate value to be sent automatically to the return circuit of the device.

Advantageously, the first and second chambers are respectively connected to the high-pressure fluid supply circuit on each side of the first calibrated orifice by first and second connecting ducts.

For preference, the regulator comprises a second calibrated orifice situated on the second connecting duct.

According to an alternative of the invention, the bore of the slide of the regulator is situated on the high-pressure fluid supply circuit, and the first calibrated orifice is formed in the body of the slide of the regulator.

According to one feature of the invention, the first face of the slide of the regulator is constantly subjected to the pressure upstream of the first calibrated orifice, whereas the second face of the slide of the regulator is constantly subjected to the action of a spring and to the pressure downstream of the first calibrated orifice.

According to another feature of the invention, the annular groove is connected to the first chamber when the pressure difference across the first calibrated orifice is greater than the pressure exerted by the spring on the second face of the slide.

Advantageously, the slide of the regulator and the bore in which the slide is mounted comprise several different successive sections, the slide and the bore delimiting an annular chamber antagonistic to the first chamber and connected to the second chamber by a calibrated orifice.

According to another alternative of the invention, the slide of the regulator and the bore in which the slide is mounted comprise several different successive sections, the slide and the bore delimiting an annular chamber antagonistic to the second chamber and connected to the high-pressure fluid supply circuit upstream of the first chamber by a calibrated orifice.

In any event, the invention will be clearly understood with the aid of the description which follows, with reference to the attached schematic drawing which, by way of nonlimiting examples, depicts a number of embodiments of the device.

FIG. 1 depicts a percussion device actuated by a pressurized incompressible fluid.

Figure 1:
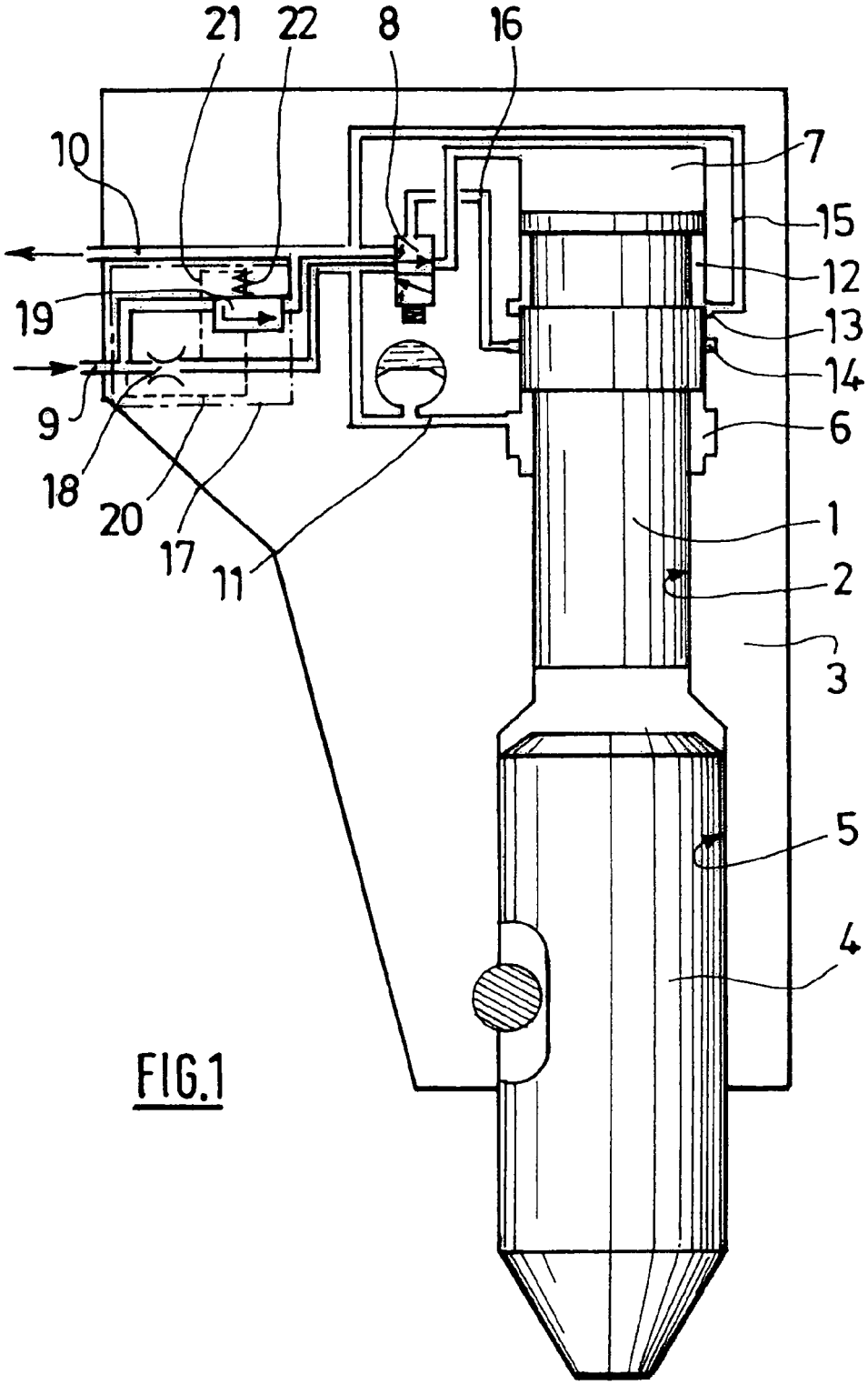
FIG. 1 depicts a schematic longitudinal section of a first percussion device.

The percussion device comprises a stepped piston 1 that can be moved back and forth inside a stepped cylinder 2 formed in the body 3 of the device, and on each cycle striking a tool 4 slidably mounted in a bore 5 formed in the body 3 coaxial with the cylinder 2.

The piston 1 delimits with the cylinder 2 a bottom annular chamber 6 and a top annular chamber 7 of larger cross section formed above the piston 1.

A main directional control valve 8 mounted in the body 3 allows the top chamber 7 to be placed alternately in communication with a high-pressure fluid supply circuit 9 during the accelerated down stroke of the piston for striking, or with a low-pressure return circuit 10 during the piston upstroke.

The annular chamber 6 is permanently supplied with high-pressure fluid by a duct 11 in such a way that each position of the slide of the directional control valve 8 causes the striking stroke of the piston 1, followed by the upstroke.

A groove 12 is formed in the top part of the piston 1, grooves 13, 14 and ducts 15 and 16 are formed in the body 3 of the device and constitute hydraulic means that can be used to trigger the movement of the main directional control valve 8.

The device depicted schematically in FIG. 1 also comprises a flow regulator 17 mounted on the high-pressure fluid supply circuit 9 and connected to the low-pressure return circuit 10.

The regulator 17 comprises a calibrated orifice 18 which may be of adjustable or fixed cross section and a slide 19 the movement of which is determined by the pressures 20 and 21 considered on each side of the calibrated orifice 18 and applied to these ends. The regulator further comprises a spring 22 determining the reference value needed for the movement of the slide 19. The operation of the regulator 17 may be likened to that of a three-way hydraulic flow splitter which, when the pressure difference across the calibrated orifice 18 increases beyond a predetermined value, diverts some of the inlet flow to the return circuit 10.

The use of a calibrated orifice of adjustable cross section allows the value of flow rate beyond which some of the inlet flow rate will be diverted to the return circuit to be set in advance. This arrangement makes it possible to obtain a flow regulator that forms a standard subassembly that can be fitted to various percussion devices, the cross section of the calibrated orifice being set in advance according to the operating characteristics of the percussion device intended to accept said regulator.

Various embodiments of this flow regulator will now be described.

Figure 2:
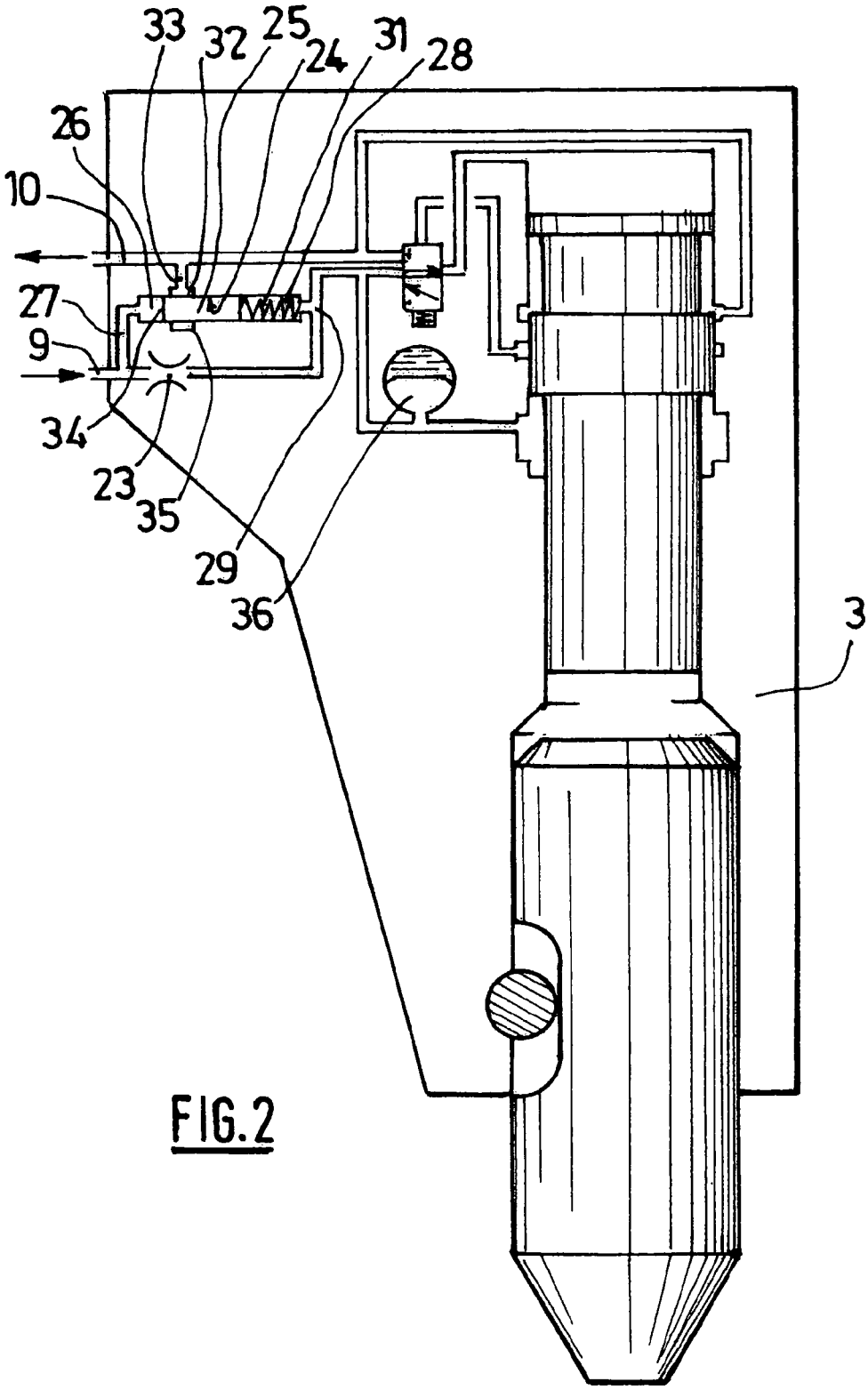
FIG. 2 depicts a longitudinal section of a second percussion device.

FIG. 2 depicts a second percussion device actuated by a pressurized incompressible fluid in which the flow regulator 17 comprises a calibrated orifice 23 situated on the pressurized-fluid supply circuit 9 and which creates, in accordance with the laws of hydraulics, a pressure drop that is proportional to the flow rate passing through it.

The regulator 17 also comprises a bore 24 formed in the body 3 of the device and in which there is mounted a slide 25 a first face of which is situated in a first chamber 26 connected to the high-pressure fluid supply circuit 9 upstream of the calibrated orifice 23 via a first connecting duct 27 and the second face of which is situated in a second chamber 28 connected to the high-pressure fluid supply circuit 9 downstream of the calibrated orifice 23 via a second connecting duct 29. It should be noted that the first and second chambers 26, 28 have equal cross sections.

The first face of the slide 25 is constantly subjected to the pressure upstream of the calibrated orifice 23, whereas the second face of the slide 25 is constantly subjected to the action of a spring 31 housed in the second chamber 28 and to the pressure downstream of the calibrated orifice 23.

The bore 24 of the slide 25 comprises an annular groove 32 connected to the return circuit 10 of the percussion device by a duct 33. The annular groove 32 is intended to be connected to the first chamber 26 when the pressure difference across the calibrated orifice 23 is greater than the pressure exerted by the spring 31 on the second face of the slide 25.

When the percussion device is operating within the limits of flow rates set by the manufacturer of this device, the pressure difference across the calibrated orifice 23 does not generate enough of a differential force on the slide 25 to counter the reactive force created by the spring 31. As a result, the annular groove 32 cannot be connected to the first chamber 26. What this means is that no flow is dumped to the return circuit 10.

By contrast, as soon as the pressurized-fluid supply flow rate exceeds a predetermined maximum value, the difference in hydraulic forces applied to the slide 25 exceeds the strength of the spring 31, and this causes the slide 25 to move away from the first chamber 26. When the knife edge 34 of the slide 25 uncovers the knife edge 35 of the annular groove 32, the first chamber 26 is connected to the annular groove 32 and pressurized fluid is diverted to the low-pressure return circuit 10 so as to allow only the maximum permissible flow proportional to the pressure drop created to flow through the calibrated orifice 23.

It should be noted that the reciprocating movement of the striking piston 1 under the action of the hydraulic forces creates fluctuations in the pressure of the supply fluid which, although attenuated by the accumulator 36, carry the risk of causing the slide 25 to move at too high a frequency for the spring 31 to tolerate if it is to have a good fatigue life.

Figure 3:
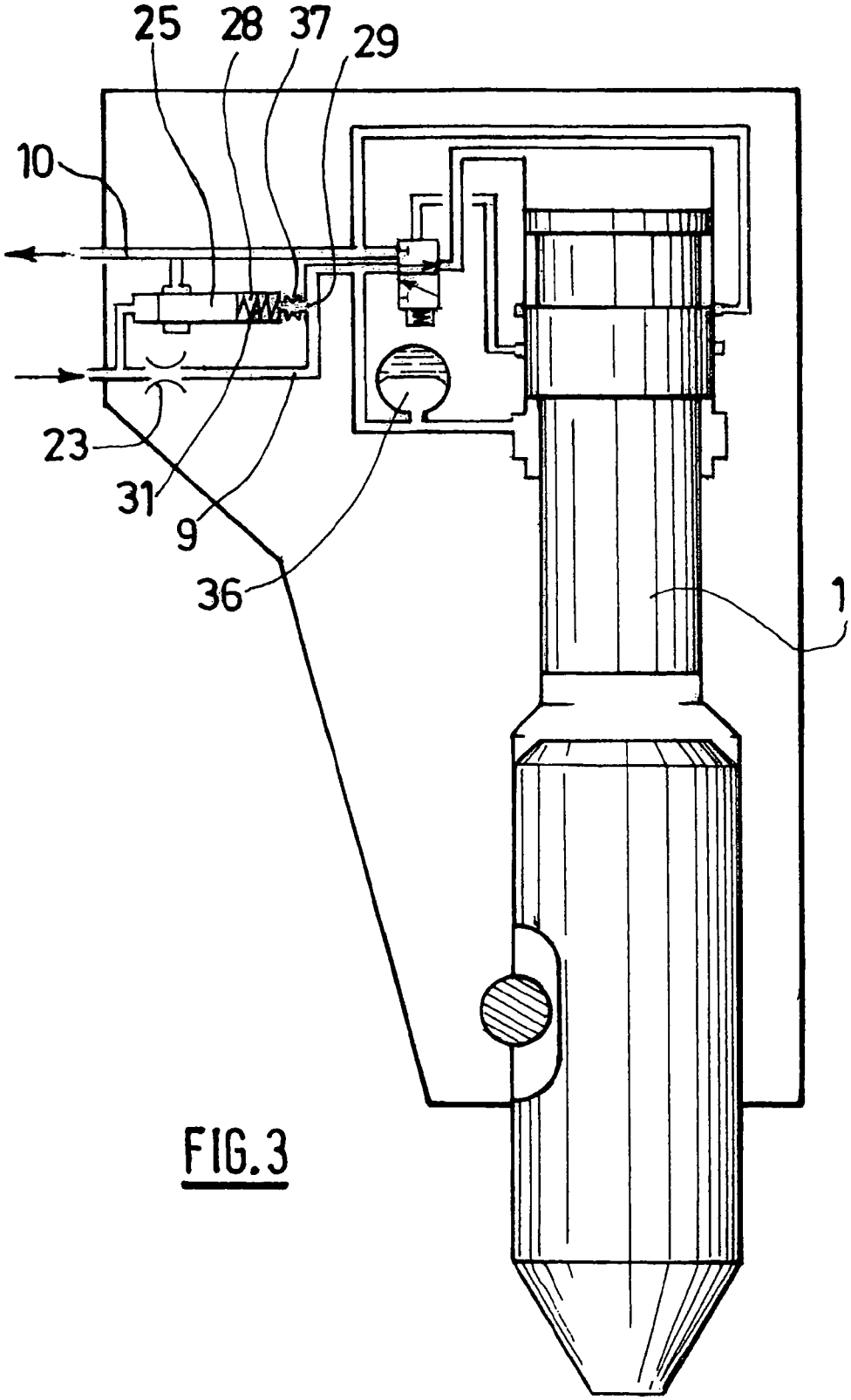
FIG. 3 depicts a longitudinal section of an alternative form of the device depicted in FIG. 2.

To alleviate this disadvantage, according to an alternative form of embodiment of the second percussion device depicted in FIG. 3, the regulator 17 further comprises a calibrated orifice 37 situated on the second connecting duct 29.

The calibrated orifice 37 is intended to oppose the instantaneous variations in flow rate between the second chamber 28 and the duct 29 which are created by the rate of travel of the slide 25. The damping effect, known as a "dashpot", generated by the calibrated orifice 37, by opposing these instantaneous variations in flow rate, makes it possible to slow the high-frequency changes in speed of the slide 25 and therefore protect the spring 31 against the effects of accelerated mechanical fatigue.

Figure 4:
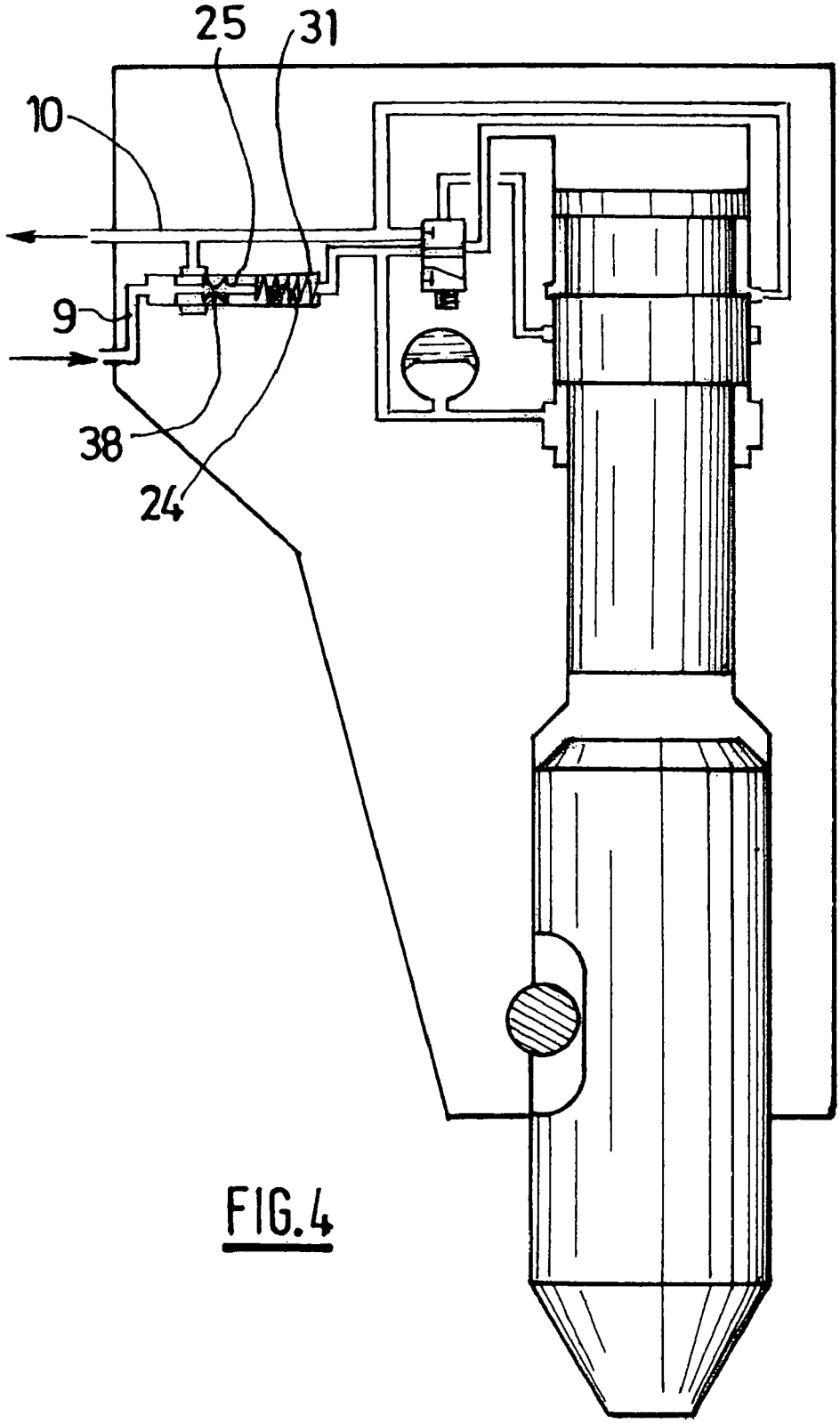
FIG. 4 depicts a longitudinal section of a third percussion device.

FIG. 4 depicts a third percussion device which differs from the one depicted in FIG. 2 in that the bore 24 of the slide 25 is situated on the high-pressure fluid supply circuit 9 and in that the calibrated orifice 23 has been replaced by a calibrated orifice 38 formed in the body of the slide 25. This structure of the regulator 17 results in a saving in material of the body 3 of the device and simplifies the supply circuits of the device.

Figure 5:
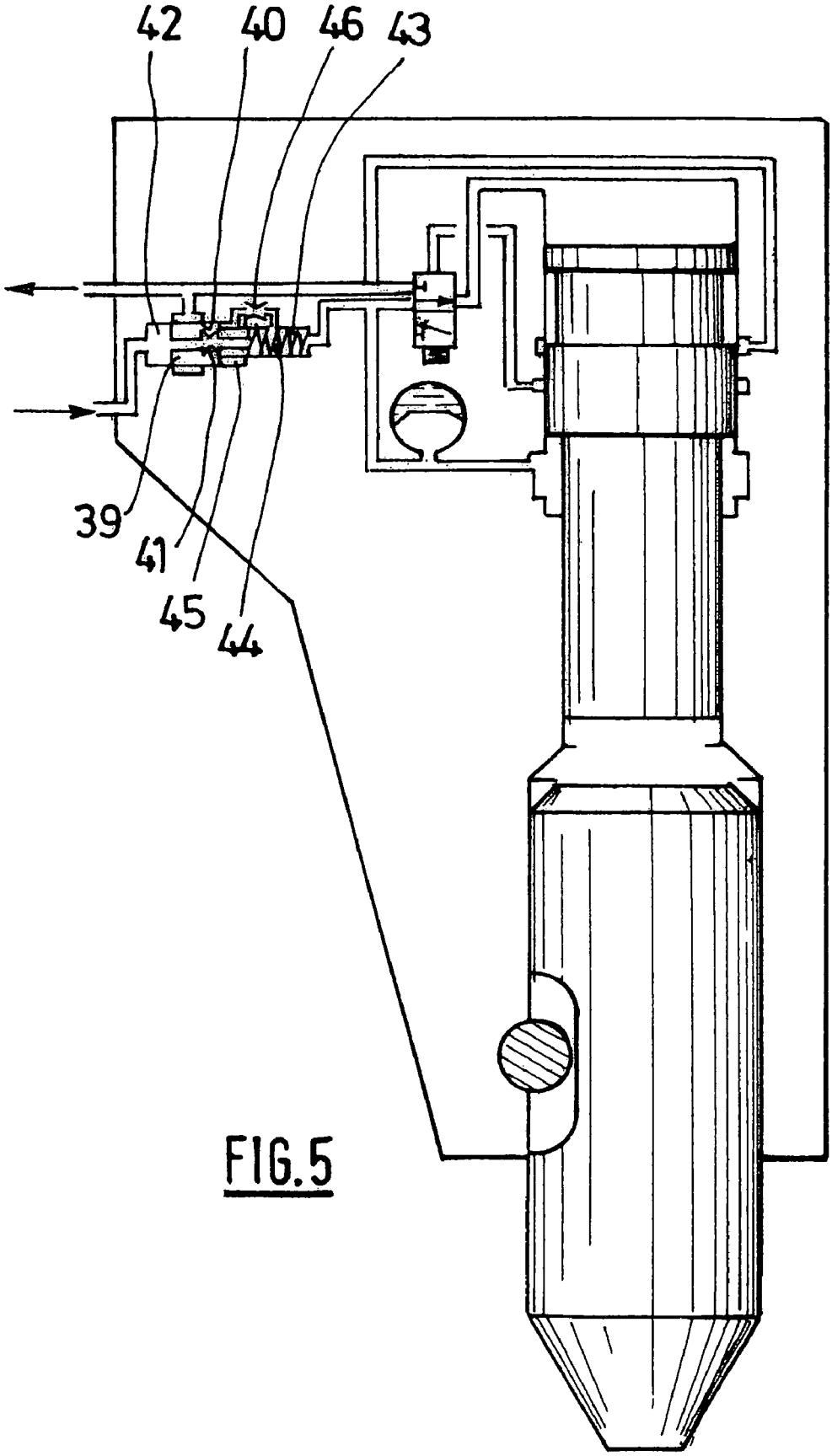
FIG. 5 depicts a longitudinal section of an alternative form of the device depicted in FIG. 4.

FIG. 5 depicts an alternative form of embodiment of the percussion device depicted in FIG. 4.

According to this embodiment, the regulator 17 comprises a stepped slide 39 mounted in a stepped bore 40, the bore 40 being situated on the high-pressure fluid supply circuit 9. A calibrated orifice 41 is formed in the body of the slide 39.

The slide 39 and the bore 40 delimit three distinct chambers, namely a first chamber 42 connected to the high-pressure fluid supply circuit upstream of the calibrated orifice 41, a second chamber 43 antagonistic to the first chamber 42, connected to the high-pressure fluid supply circuit downstream of the calibrated orifice 41 and in which there is housed a spring 44, and finally an annular chamber 45 antagonistic to the first chamber 42 and connected to the second chamber 43 by a calibrated orifice 46.

It should be noted that the sum issue of the respective cross sections of the chambers 43 and 45 is equal to the cross section of the first chamber 42. Thus, equilibrium in operation of the slide 39 will be identical to that of the slide 25 which with its bore delimits two antagonistic chambers of equal cross sections.

The calibrated orifice 46 is intended to generate a damping effect known as the "dashpot effect" that damps the movement of the slide 39 by opposing the instantaneous variations in flow rate between the chambers 43 and 45. This arrangement makes it possible to limit the mechanical fatigue of the spring 44.

Figure 6:
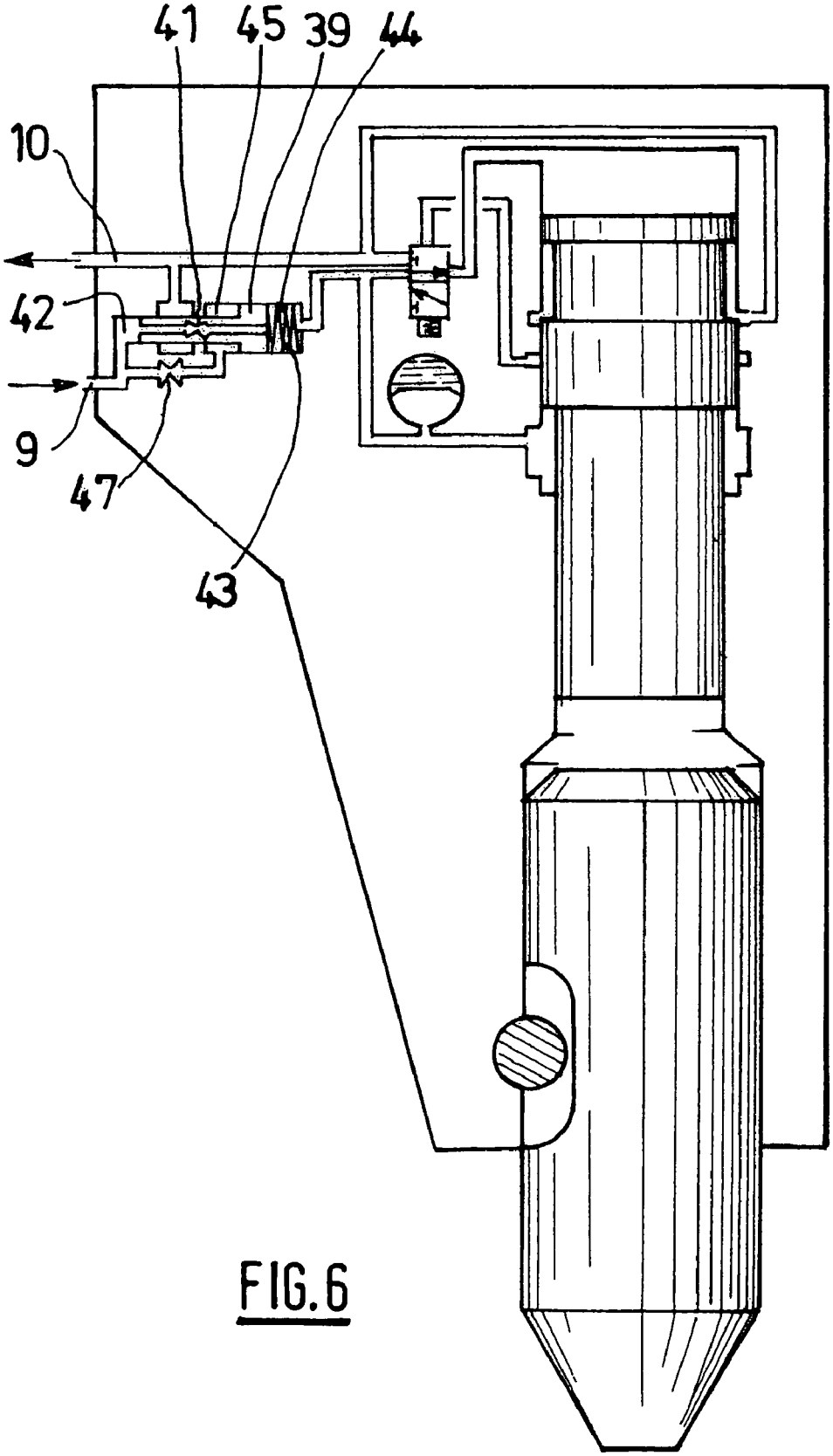
FIG. 6 depicts a longitudinal section of a fourth percussion device.

FIG. 6 depicts a fourth percussion device which differs from the one depicted in FIG. 5 in that the annular chamber 45 is antagonistic to the second chamber 43 which comprises the spring 44. In order to preserve pressure equilibrium, the annular chamber 45 is connected to the pressurized-fluid supply circuit 9 by a calibrated orifice 47 which is intended to create the same damping effect as the calibrated orifice 46 shown in FIG. 5.

As goes without saying, the invention is not restricted merely to the embodiments of this device which have been described hereinabove by way of example but on the contrary encompasses all embodiment variants thereof.

The invention claimed is:

1. A percussion device actuated by a pressurized incompressible fluid, a supply of fluid to which is performed by a high-pressure fluid supply circuit and a low-pressure return circuit, wherein:

a body of the device comprises a flow regulator, the flow regulator comprising a first calibrated orifice situated on the high-pressure fluid supply circuit, and a bore formed in the body of the device and in which there is mounted a slide, a first face of which is situated in a first chamber connected to the high-pressure fluid supply circuit upstream of the first calibrated orifice and a second face of which is situated in a second chamber connected to the high-pressure fluid supply circuit downstream of the first calibrated orifice, the bore accepting the slide of the regulator comprising an annular groove connected to the return circuit of the percussion device, the slide of the regulator is designed to connect the annular groove to the first chamber where the pressure difference across the first calibrated orifice increases beyond a predetermined value, so as to divert some of the fluid flow supplied by the high-pressure fluid supply circuit to the return circuits, the first face of the slide of the regulator is constantly subjected to the pressure upstream of the first calibrated orifice, and the second face of the slide of the regulator is constantly subjected to the action of a spring and to the pressure downstream of the first calibrated orifice.

2. The percussion device as claimed in claim 1, wherein the first and second chambers are respectively connected to the high-pressure fluid supply circuit on each side of the first calibrated orifice by first and second connecting ducts.

3. The percussion device as claimed in claim 2, wherein the regulator comprises a second calibrated orifice situated on the second connecting duct.

4. The percussion device as claimed in claim 1, wherein the bore of the slide of the regulator is situated on the high-pressure fluid supply circuit, and in that the first calibrated orifice is formed in the body of the slide of the regulator.

5. The percussion device as claimed in claim 4, wherein the slide of the regulator and the bore in which the slide is mounted comprise several different successive sections, the slide and the bore delimiting an annular chamber antagonistic to the first chamber and connected to the second chamber by a calibrated orifice.

6. The percussion device as claimed in claim 4, wherein the slide of the regulator and the bore in which the slide is mounted comprise several different successive sections, the slide and the bore delimiting an annular chamber antagonistic to the second chamber and connected to the high-pressure fluid supply circuit upstream of the first chamber by a calibrated orifice.

7. The percussion device as claimed in claim 1, wherein the annular groove is connected to the first chamber when the pressure difference across the first calibrated orifice is greater than the pressure exerted by the spring on the second face of the slide.

* * * * *